US010582765B1

(12) United States Patent
Duell et al.

(10) Patent No.: US 10,582,765 B1
(45) Date of Patent: Mar. 10, 2020

(54) AUTOMATED BRUSH CLEANING AND DRYING APPARATUS

(71) Applicants: Christine Elizabeth Duell, Los Angeles, CA (US); Spencer Mackay, Agoura Hills, CA (US); Alan Crawford, Glendale, CA (US); Takuya Idehara, Sherman Oaks, CA (US); Kimberlee Cozby Muenzer, La Cañada, CA (US)

(72) Inventors: Christine Elizabeth Duell, Los Angeles, CA (US); Spencer Mackay, Agoura Hills, CA (US); Alan Crawford, Glendale, CA (US); Takuya Idehara, Sherman Oaks, CA (US); Kimberlee Cozby Muenzer, La Cañada, CA (US)

( * ) Notice: Subject to any disclaimer, the term of this patent is extended or adjusted under 35 U.S.C. 154(b) by 0 days.

(21) Appl. No.: 16/121,316

(22) Filed: Sep. 4, 2018

Related U.S. Application Data

(60) Provisional application No. 62/553,398, filed on Sep. 1, 2017.

(51) Int. Cl.

| | |
|---|---|
| ***A46B 17/06*** | (2006.01) |
| ***B08B 11/02*** | (2006.01) |
| ***F26B 5/00*** | (2006.01) |
| ***B08B 3/04*** | (2006.01) |

(52) U.S. Cl.
CPC ..... *A46B 17/06* (2013.01); *B08B 3/04* (2013.01); *B08B 11/02* (2013.01); *F26B 5/00* (2013.01); *A46B 2200/1046* (2013.01)

(58) Field of Classification Search
None
See application file for complete search history.

(56) References Cited

U.S. PATENT DOCUMENTS

| | | | | |
|---|---|---|---|---|
| 7,640,941 | B2 | 1/2010 | Watters et al. | |
| 2014/0096801 | A1 | 4/2014 | McCormick | |
| 2017/0119145 | A1* | 5/2017 | Munoz | A46B 17/065 |

* cited by examiner

*Primary Examiner* — Mikhail Kornakov
*Assistant Examiner* — Ryan L. Coleman
(74) *Attorney, Agent, or Firm* — Plager Schack LLP

(57) ABSTRACT

An automated brush cleaning and drying apparatus includes a housing, a cleaning solution bottle coupled to the housing and a spray nozzle, a fan coupled to the housing, a support frame assembly disposed within the housing, a rotation mechanism assembly coupled to the support frame assembly and having a rotatable claw designed to engage with the brush's end tip, and a height adjustment mechanism assembly operably coupled to the support frame assembly within the housing. The height adjustment mechanism assembly adjusts the height of the support frame assembly to a first position to permit the rotation mechanism assembly to drive the rotatable claw to rotate the brush as the spray nozzle disperses the cleaning solution from the bottle to the brush's bristles. The height adjustment mechanism assembly adjusts the height of the support frame assembly to a second position to align the brush's bristles with the fan.

8 Claims, 5 Drawing Sheets

AUTOMATED BRUSH CLEANING AND DRYING APPARATUS

RELATED APPLICATION

The application claims priority to provisional U.S. patent application Ser. No. 62/553,398 filed on Sep. 1, 2017, the entire contents of which is herein incorporated by reference.

BACKGROUND

The embodiments herein relate generally to small appliances. More specifically, embodiments of the invention relate to an automated brush cleaning and drying apparatus for use with makeup brushes.

Dirty and/or used makeup brushes are breeding grounds for bacteria, which multiply quickly unless the brushes are routinely cleaned. Bacteria growth in makeup brushes can cause acne breakouts in users upon contact and decay in the makeup brush's shelf life. Many people are unaware of how often cosmetic brushes should be cleaned. Currently, it takes approximately up to 24 hours to wash and dry makeup brushes manually by hand or while utilizing available cleaning tools or machines.

The current methods and/or devices for cleaning makeup brushes rely on the user's determination of, if and when, the brushes need cleaning and require the user to be present while the brushes are being cleaned. As such, these conventional cleaning methods require user involvement during the brush cleaning process. These cleaning methods have further limitations in that they do not speed up the drying time of the brushes and can potentially damage the brushes by loosening the glue that holds the hair or synthetic fibers in place, thereby permanently misshaping the brushes. Other brush cleaning devices disclosed in U.S. Patent Application Publication 2014/0096801 and U.S. Pat. No. 7,640,941 do not clean and dry brushes effectively and efficiently.

As such, there is a need in the industry for a makeup brush cleaning and drying apparatus that overcomes the limitations of the prior art. Specifically, there is a need for an apparatus designed to easily wash and dry makeup brushes with enhanced effectiveness and efficiency. This significantly cuts down the time to wash and dry the makeup brushes, which permits the user to use the cleaned makeup brushes within the same day.

SUMMARY

An automated cleaning and drying apparatus configured for use to clean a brush with enhanced efficiency is provided. The brush comprises a bristle portion coupled to a handle with an end tip. The cleaning and drying apparatus comprises a main housing, a bottle coupled to the main housing and comprising cleaning solution stored therein, the bottle connected to a spray nozzle configured to disperse the cleaning solution, a fan coupled to the main housing, a support frame assembly partially disposed within the main housing, a rotation mechanism assembly coupled to the support frame assembly and comprising a rotatable claw configured to engage the end tip of the brush, and a height adjustment mechanism assembly operably coupled to the support frame assembly within the main housing, the height adjustment mechanism assembly configured to adjust a height of the support frame assembly relative to the main housing, wherein the height adjustment mechanism assembly is configured to adjust the height of the support frame assembly to a first position to permit the rotation mechanism assembly to drive the rotatable claw to rotate the brush as the spray nozzle disperses the cleaning solution from the bottle to the bristle portion of the brush, wherein the height adjustment mechanism assembly is configured to adjust the height of the support frame assembly to a second position to align the bristle portion of the brush with the fan.

In certain embodiments of the invention, the automated cleaning and drying apparatus comprises a plurality of support frame assemblies, a plurality of rotation mechanism assemblies and a plurality of height adjustment mechanism assemblies coupled to the main housing to allow for the simultaneous cleaning and drying of a plurality of brushes.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

In the following detailed description of the invention, numerous details, examples, and embodiments of the invention are described. However, it will be clear and apparent to one skilled in the art that the invention is not limited to the embodiments set forth and that the invention can be adapted for any of several applications.

As depicted in FIGS. 1-5, the automated cleaning and drying apparatus is configured to clean and dry a plurality of brushes such as first exemplary brush 100, second exemplary brush 102 and third exemplary brush 104. The apparatus is configured to perform a wash and dry procedure on any one or more brushes selected from first, second and third brushes 100, 102, 104.

Figure 4:
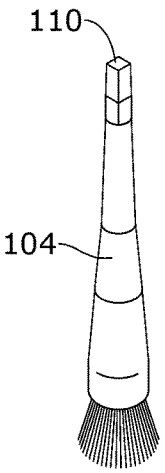
FIG. 4 depicts a perspective view of a brush for use with certain embodiments of the automated cleaning and drying apparatus.
Figure 5:
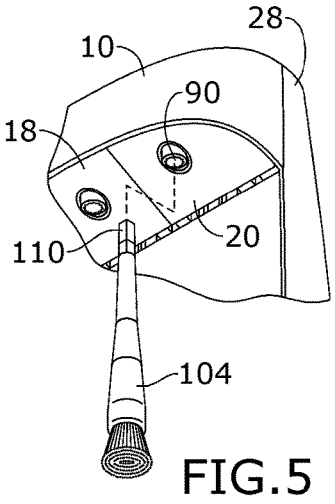
FIG. 5 depicts a bottom front perspective view of certain embodiments of the automated cleaning and drying apparatus illustrating the engagement of the brush with claw 90 of the apparatus.

First, second and third brushes 100, 102, 104 are preferably makeup brushes. However, it shall be appreciated that the apparatus may be beneficial for use with any alternative types of brushes including, but not limited to, toothbrushes, paint brushes, rollers, and the like. In a preferred embodiment, each brush 100, 102, 104 comprises a bristle portion connected to a handle with tip 110 as depicted in FIGS. 4-5. Tip 110 of each brush 100, 102, 104 is configured to engage with claw 90 of the apparatus as will be described in more detail in the following embodiments. In one embodiment, tip 110 of each brush 100, 102, 104 comprises an embedded metal member such as steel or other metal.

As depicted in FIGS. 1-3, 6 and 8, the automated cleaning and drying apparatus generally comprises a housing comprising top housing portion 10, front housing portion 22 and rear housing portion 28 connected together, a drying system comprising fans 44, a washing system comprising pumps 88, cleaning solution bottle 36, tubing 108 and spray nozzle tips 96, rotation mechanism assemblies configured to rotate brushes 100, 102, 104 during a cleaning cycle, and height adjustment mechanism assemblies configured to raise and lower brushes 100, 102, 104 as needed.

Figure 6:
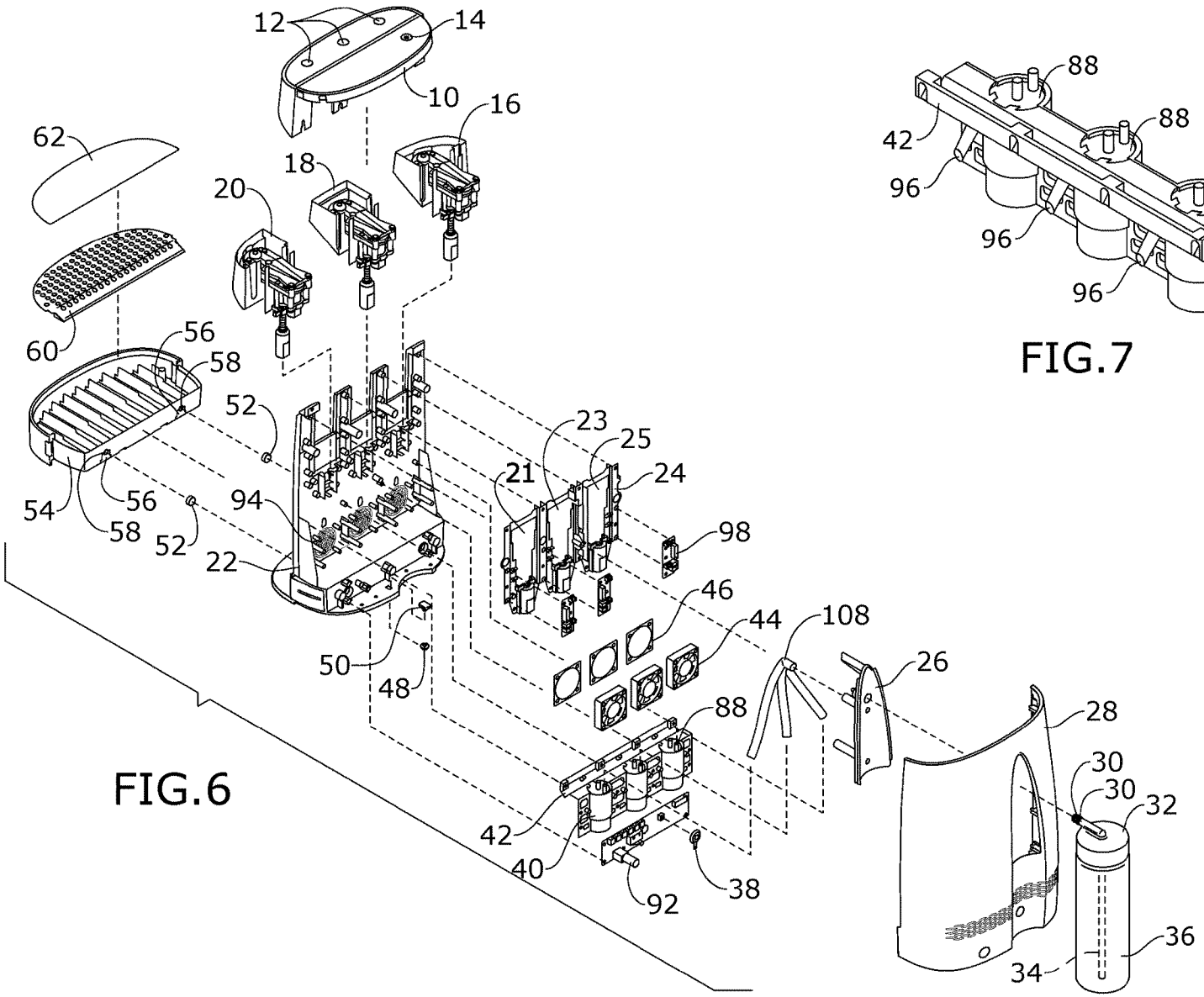
FIG. 6 depicts a rear exploded view of certain embodiments of the automated cleaning and drying apparatus.
Figure 8:
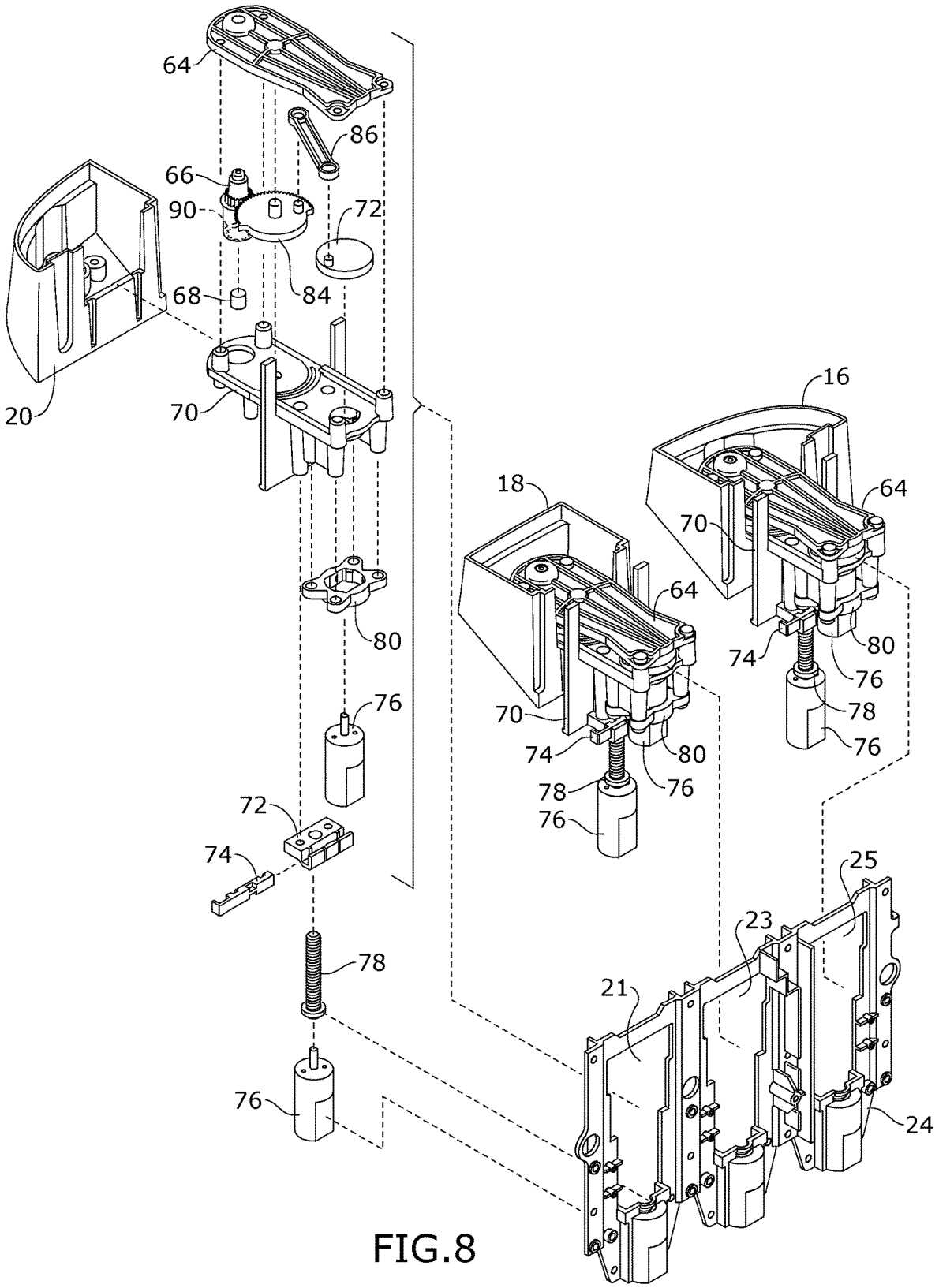
FIG. 8 depicts an exploded view of certain embodiments of the automated cleaning and drying apparatus illustrating the support frame assemblies and slider housing.

As depicted in FIGS. 6 and 8, front housing portion 22 comprises upper cutouts configured to receive brush holder assemblies that correspond to first, second and third brushes 100, 102, 104. The different brush holder assemblies are denoted by their respective outer caps including left holder cap 16, center holder cap 18 and right holder cap 20. Although the figures depict three brush holder assemblies for use with first, second and third brushes 100, 102, 104, it shall be appreciated that the apparatus may comprise any alternative number of brush holder assemblies to accommodate any alternative number of brushes.

As depicted in FIG. 8, each brush holder assembly comprises the same internal components and is coupled to a rotation mechanism assembly and a height adjustment mechanism assembly. As such, attention is directed to the right brush holder assembly for simplicity. The right brush holder assembly comprises support frame assembly upper body 64, support frame assembly lower body 70 and right holder cap 20. As depicted in FIGS. 6 and 8, support frame assembly upper and lower bodies 64, 70 are coupled together and seated within one of the upper cutouts in front housing portion 22. In this position, a portion of support frame assembly lower body 70 is coupled to right holder cap 20 outside front housing portion 22.

In certain embodiments, a rotation mechanism assembly is coupled to the right brush holder assembly and comprises gear motor 76, trapezoid nut plate 72, linkage arm 86, drive gear 84, and pinion gear 66, which is coupled to the shaft of claw 90. In one embodiment, gear motor 76 is coupled to the bottom of support frame assembly lower body 70 by support bracket 80 and mechanical fasteners. In one embodiment, gear motor 76 is a DC 12V, N20 high torque gear motor rated at 100 rpm. However, gear motor 76 may comprise alternative specifications in an alternative embodiment.

Trapezoid nut plate 72 is disposed on support frame assembly lower body 70 and operably connected to gear motor 76. Drive gear 84 is rotatably mounted to support frame assembly lower body 70. Linkage arm 86 operably connects trapezoid nut plate 72 to drive gear 84. Pinion gear 66 engages with drive gear 84, which allows the shaft connected to pinion gear 66 to extend through an opening in support frame assembly lower body 70. The end of the shaft comprises claw 90, which may comprise any teeth or protrusions designed to help retain tip 110 of brush 100, 102, 104 therein. Upon activation of gear motor 76, rotational movement of gear motor 76 transfers through trapezoid nut plate 72, linkage arm 86, drive gear 84, pinion gear 66 and rotatable claw 90 to rotate any brush 100,102, 104 coupled thereto. In an alternative embodiment, the rotation mechanism assembly comprises any alternative components for use with gear motor 76 to drive claw 90 including, but not limited to, various gear, belt and/or pulley components.

In one embodiment, magnet 68 is coupled to the interior of each claw 90 in the apparatus using an adhesive, snap-fit connection or other fastener. Magnet 68 attracts the embedded metal member in tip 110 of each brush 100, 102, 104 to enhance securement of the brush within claw 90.

In one embodiment, a height adjustment mechanism assembly is coupled to each brush holder assembly and comprises trapezoid nut plate 72, sensor plate 74, trapezoid screw 78, another gear motor 76 and slider housing 24. As depicted in FIGS. 6 and 8, slider housing 24 is coupled to the rear side of front housing portion 22 by snap components, screws and/or other mechanical fasteners. Slider housing 24 comprises right slot 21, center slot 23 and left slot 25. The bottom of slider housing 24 comprises a bottom casing below each slot 21, 23, 25 configured to receive gear motor 76.

With respect to the right brush holder assembly as depicted in FIG. 8, trapezoid nut plate 72 is coupled to the bottom of support frame assembly lower body 70 and comprises a central threaded opening configured to engage with trapezoid screw 78. The end of trapezoid screw 78 is operably connected to gear motor 76. Gear motor 76 is preferably a DC 12V, N20 high torque gear motor rated at 100 rpm. However, gear motor 76 may comprise alternative specifications in an alternative embodiment. Gear motor 76 is coupled to the casing beneath right slot 21 in slider housing 24. In this assembled configuration, portions of support frame assembly upper and lower bodies 64, 70 extend through right slot 21 as depicted in FIG. 8.

Gear motor 76 of the height adjustment mechanism assembly is configured to rotate trapezoid screw 78 in a first direction relative to the threaded opening in trapezoid nut plate 72, thereby raising portions of support frame assembly upper and lower bodies 64, 70 of right brush holder assembly within right slot 21 of slider housing 24. Similarly, gear motor 76 of the height adjustment mechanism assembly is configured to rotate trapezoid screw 78 in a second direction relative to the threaded opening in trapezoid nut plate 72, thereby lowering portions of support frame assembly upper and lower bodies 64, 70 of right brush holder assembly within right slot 21 of slider housing 24. As such, the rotation of trapezoid screw 78 by gear motor 76 maneuvers the right brush holder assembly so that the brush connected to the corresponding claw 90 is raised or lowered as desired.

It shall be appreciated the center and left brush holder assemblies comprise the same components as the right brush holder assembly and operate in the same manner. As depicted in FIG. 8, the center and left brush holder assemblies insert within corresponding center and left slots 23, 25 in slider housing 24.

In one embodiment, sensor plate 74 is coupled to trapezoid nut plate 72 in each brush holder assembly and comprises photocouplers configured to sense the positioning of trapezoid screw 78 during operation of the apparatus. The photocouplers control the rotational limits of each trapezoid screw 78. In one embodiment, electronic components 98 are coupled to slider housing 24 as depicted in FIG. 6. Electronic components 98 are electrically coupled to gear motors 76 in the height adjustment mechanism assemblies and may comprise resistors or other components configured to reduce the voltage as desired.

As depicted in FIGS. 1-3 and 6-7, the washing system is coupled to the housing. Specifically, cleaning solution bottle 36 is coupled to rear housing portion 28. Cleaning solution bottle 36 comprises a reservoir configured to store an alcohol-based solution or alternative cleaning solution designed to clean the bristle portions of brushes 100, 102, 104. In one embodiment, cleaning solution bottle 36 comprises cap 32 and siphon hose 34. Siphon hose 34 extends from the interior of the bottle through cap 32. The end of siphon hose 34 comprises a spout with O-rings 30 to help prevent leakage of the cleaning solution passing through the spout.

Figure 7:
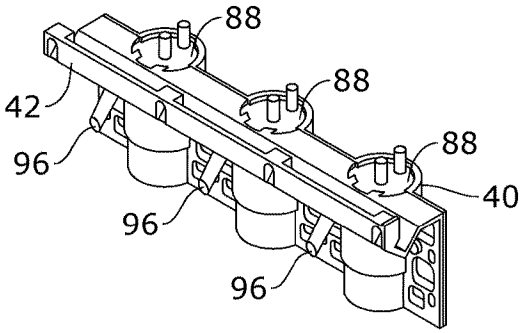
FIG. 7 depicts a perspective view of certain embodiments of the automated cleaning and drying apparatus illustrating the pump assembly.

Bottle plug 26 is coupled to an opening in rear housing portion 28 and comprises an opening configured to receive the spout of cleaning solution bottle 36. The spout of cleaning solution bottle 36 is coupled to a pump assembly comprising pumps 88. In one embodiment, a plurality of pumps 88 corresponding to first, second and third brushes 100, 102, 104 are coupled to pump holder 42, which is coupled to the rear face of front housing portion 22 using snap components, screws or other mechanical components. As depicted in FIG. 7, each pump 88 comprises cover 40 and is connected to spray nozzle tip 96, which extends through front housing portion 22 to the front of the apparatus. Tubing 108 comprises an inlet coupled to the spout of cleaning solution bottle 36 and a plurality of outlets coupled to pumps 88.

Each pump 88 can be any type of electric pump configured to facilitate the transfer of cleaning solution from cleaning solution bottle 36 through tubing 108 and out the corresponding spray nozzle tip 96.

Figure 1:
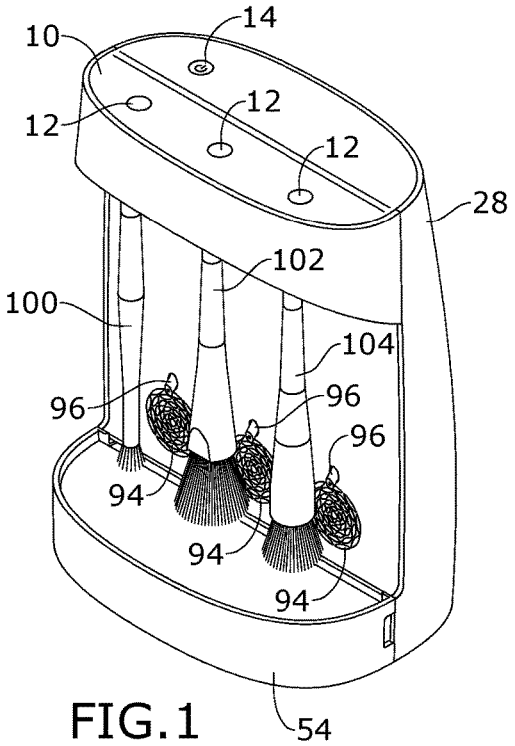
FIG. 1 depicts a top front perspective view of certain embodiments of the automated cleaning and drying apparatus shown in use.

As depicted in FIGS. 1 and 6, a drying system comprising fans 44 are coupled to the rear side of front housing portion 22 using snap components, screws or other fasteners. Vents 94 are disposed in front housing portion 22 and aligned with fans 44. In one embodiment, pads 46 are disposed between fans 44 and front housing portion 22 and extend along the perimeters of vents 94. Pads 46 may be made from any cushion member such as rubber, foam or the like, configured to reduce any rattling noise or vibrations generated during the operation of fans 44. Each fan 44 may comprise a rotatable set of blades having variable dimensions.

As depicted in FIGS. 1-3 and 6, tray 54 is detachably coupled to the front side of front housing portion 22. Tray 54 serves as a receptacle to collect cleaning solution dispersed from spray nozzle tips 96. In one embodiment, catch plate 60 is disposed on tray 54 and comprises a plurality of openings configured to permit cleaning solution to pass through. In one embodiment, mat 62 is disposed on catch plate 60 or directly on tray 54. Mat 62 is made from any cushion material such as silicon, rubber or the like, and comprises one or more openings to permit cleaning solution to pass through. It shall be appreciated that catch plate 60 and mat 62 can be used alone with tray 54 or together with tray 54 as desired.

In one embodiment, tray 54 comprises metallic armatures 58 configured to detachably couple to magnets 52, which are coupled to front housing portion 22. In one embodiment, covers 56 are disposed on metallic armatures 58 to enhance aesthetics of tray 54. In this embodiment, magnets 52 comprise attraction forces sufficient in magnitude to attract metallic armatures 58 embedded within tray 54. It shall be appreciated that alternative fastening components may be used to secure tray 54 to front housing portion 22. In an alternative embodiment, tray 54 comprises an adjustable slide mechanism configured to adjust the height of the tray when used with the apparatus. This helps the apparatus to better accommodate spray nozzle tips 96 and to enhance air flow circulation from fans 44 to reduce the drying time of brushes 100, 102, 104.

Figure 11:
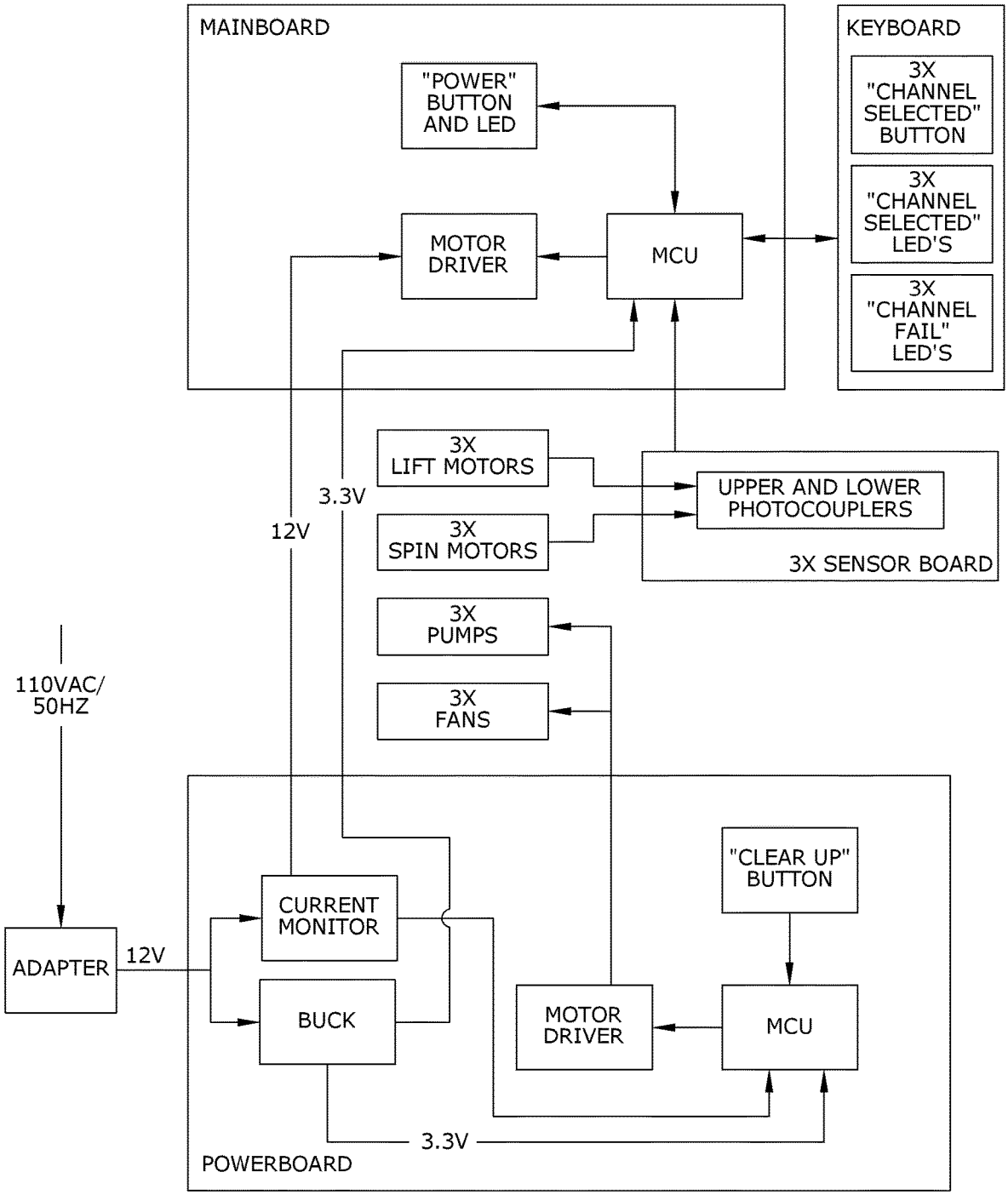
FIG. 11 depicts a circuit block diagram of certain embodiments of the automated cleaning and drying apparatus.

It shall be appreciated that any components including, but not limited to, circuits, wiring, drivers, switches, circuit boards, programmable microcontrollers and other electrical components, can be used to electrically couple the drying system, washing system, rotation mechanism assemblies and height adjustment mechanism assemblies together. FIG. 11 depicts an exemplary circuit block diagram of certain embodiments of the automated cleaning and drying apparatus. It shall be appreciated that components may be added, removed and rearranged in the circuit in alternative embodiments of the invention.

Figure 3:
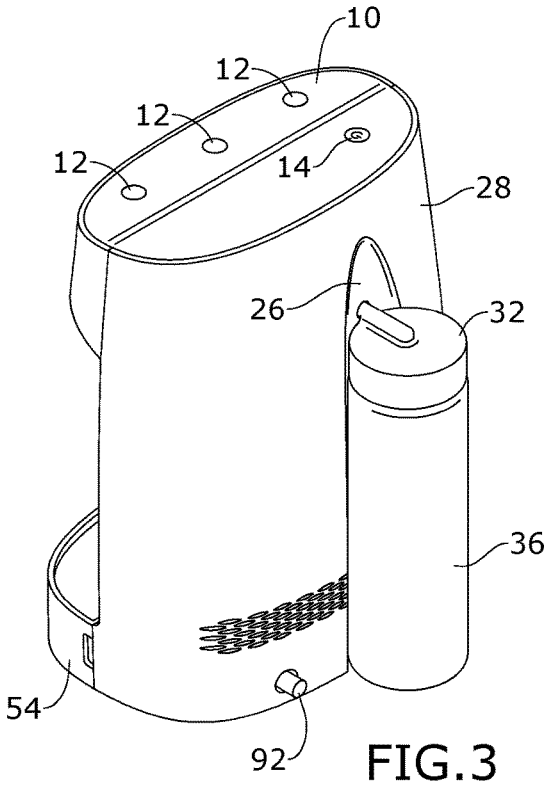
FIG. 3 depicts a top rear perspective view of certain embodiments of the automated cleaning and drying apparatus.

As depicted in FIGS. 3 and 6, power connection point 92 is coupled to front housing portion 22 and is electrically coupled to the systems, assemblies and electrical components of the apparatus. Power connection point 92 is preferably coupled to a power outlet via a plug. However, alternative power sources including, but not limited to, batteries, solar power systems, portable electrical generators and the like may be used in alternative embodiments. In one embodiment, clean button 38 is coupled to front housing portion 22 and is exposed through rear housing portion 28 when cleaning solution bottle 36 is removed. Clean button 38 is a switch electrically coupled to pumps 88 to enable the pumps for a set time to discharge any remaining cleaning solution present within tubing 108 and the piping leading to nozzle spray tips 96. The discharged cleaning solution is dispersed out of nozzle spray tips 96.

Figure 2:
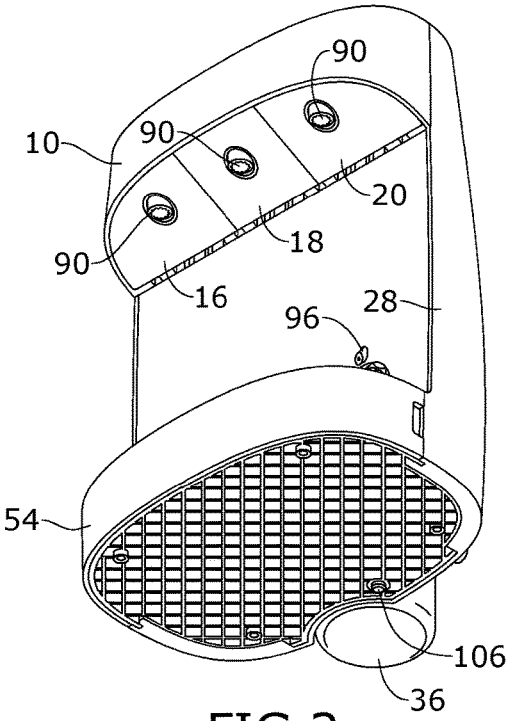
FIG. 2 depicts a bottom front perspective view of certain embodiments of the automated cleaning and drying apparatus.

As depicted in FIGS. 1-3, top housing 10 comprises brush engagement buttons 12 and power button 14. Power button 14 is electrically coupled to the microcontrollers, systems and assemblies of the apparatus and serves as a power On/Off switch. Each brush engagement button 12 serves as an On/Off switch electrically coupled to the washing system, drying system, rotation mechanism assembly and height adjustment mechanism assembly corresponding to any connected one of brushes 100, 102, 104. In certain embodiments, power button 14 and brush engagement buttons 12 comprise lighting components such as LEDs to indicate the position of the buttons.

As depicted in FIGS. 2 and 6, anti-tip foot 106 is coupled to lever 50 and lever cover 48. Lever 50 is configured to permit anti-tip foot 106 to extend out the bottom of front housing portion 22 and retract within front housing portion 22. Lever 50 is operably connected to a switch that is configured to enable the automated cleaning and drying apparatus to operate when anti-tip foot 106 is retracted within front housing portion 22 and disable when anti-tip foot 106 extends outside of front housing portion 22. As such, anti-tip foot 106 and lever 50 serve as an over-ride safety switch that permits the apparatus to operate only when safely placed on a flat surface that pushes anti-tip foot 106 within front housing portion 22.

In operation, the automated cleaning and drying apparatus is disposed on a flat surface such as a table or countertop. The components of the apparatus are attached as depicted in FIGS. 1-3. Any number of brushes 100, 102, 104 are coupled to the apparatus by inserting tip 110 of each brush to engage with a corresponding claw 90 as depicted in FIG. 5. FIG. 1 depicts brushes 100, 102, 104 coupled to the apparatus in preparation for a cleaning and drying procedure.

The user presses power button 14 to activate the apparatus in an operational mode. The user depresses any desired brush engagement button 12 to perform a cleaning and drying procedure on the selected brush 100, 102, 104. As such, the apparatus can clean and dry brushes 100, 102, 104 simultaneously or at different times as desired.

Upon pressing brush engagement button 12, the height adjustment mechanism assembly corresponding to the selected brush 100, 102, 104 lowers the brush so that the bristle portion contacts mat 62 or catch plate 60. The rotation mechanism assembly corresponding to the selected brush 100, 102, 104 drives claw 90 to rotate the brush in an alternating clockwise and counter-clockwise movement pattern. In one embodiment, gear motor 76 of the rotation mechanism assembly is configured to rotate the selected brush 100, 102, 104 in an alternating +/−360 degrees. During the rotation of the brush, pump 88 corresponding to the selected brush 100, 102, 104 pumps cleaning solution from cleaning solution bottle 36 through tubing 108 and spray nozzle tip 96 to disperse directly on the bristles of the rotating brush. After a predetermined time programmed in the microcontroller, the rotation mechanism assembly is disabled and the height adjustment mechanism assembly raises the selected brush 100, 102, 104 to align the bristles with vent 94 and fan 44. Fan 44 is enabled to direct air flow through vent 94 to the bristles of the brush to complete a drying procedure.

The cleaning and drying procedures are completed for each selected brush 100,102,104. The dispersed cleaning solution from spray nozzle tips 96 collect within tray 54, which can be detached from the housing to discard the used cleaning solution.

It shall be appreciated that the microcontrollers, circuits and systems of the automated cleaning and drying apparatus can be programmed to vary the sequence of steps, procedure and time to complete the cleaning and drying procedures.

Figure 9:
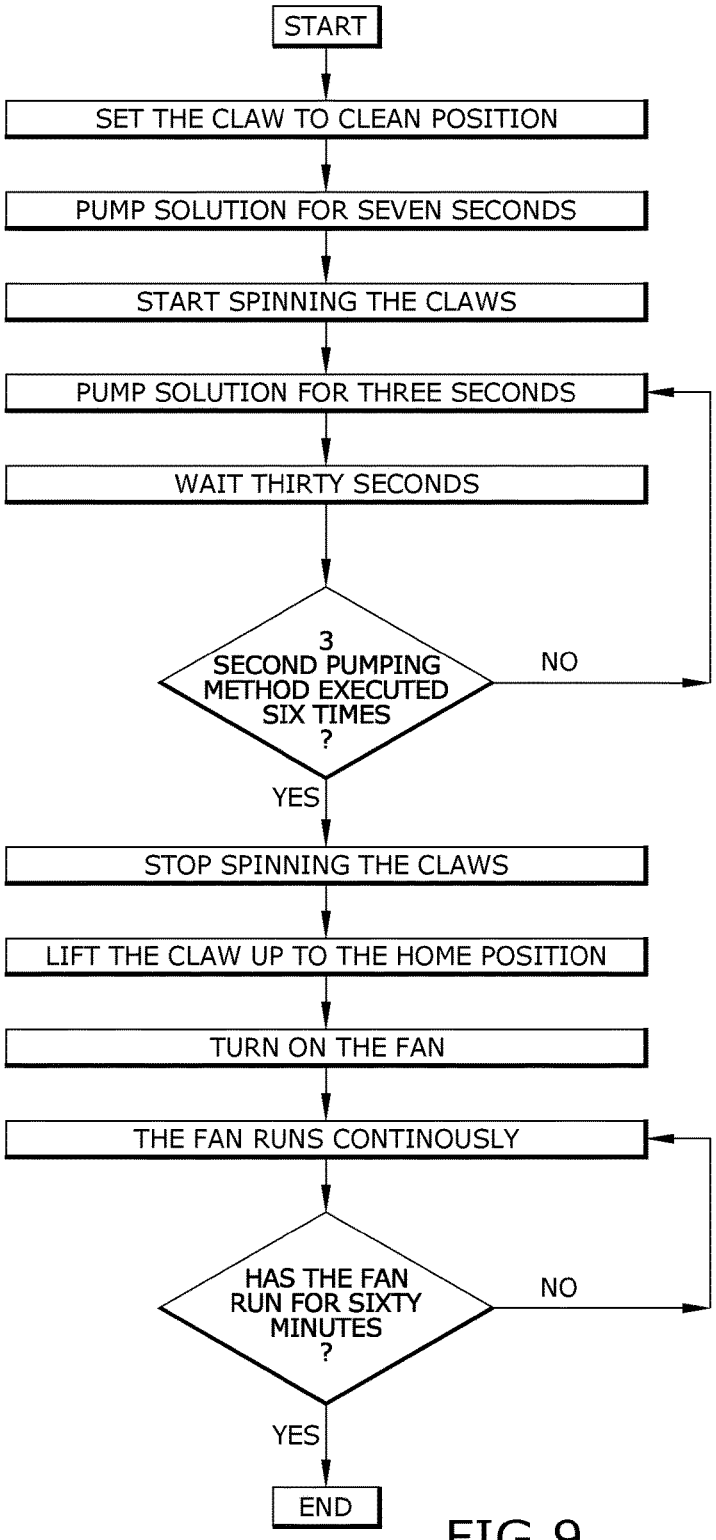
FIG. 9 depicts a flowchart of a method for cleaning and drying a brush in accordance with certain embodiments of the invention.

In one embodiment, FIG. 9 illustrates the steps performed by the cleaning and drying apparatus during a cleaning and drying procedure for a selected brush 100, 102, 104. In this embodiment, claw 90 of the rotation mechanism assembly corresponding to the selected brush 100, 102, 104 is set in the clean position aligned with spray nozzle tip 96. Pump 88 disperses cleaning solution via spray nozzle tip 96 directly on the bristles of the brush. The rotation mechanism assembly spins claw 90 to rotate the selected brush. Pump 88 disperses cleaning solution on the bristles of the rotating brush for repeated 3 second time intervals with 30 second rest-time intervals between each 3 second interval. The number of repeat cycles is programmed in the microcontroller of the apparatus. After a predetermined time, the rotation mechanism assembly stops the rotation of claw 90. The height adjustment mechanism assembly lifts claw 90 to the home position so the bristles of the brush are aligned with fan 44 and vent 94. Fan 44 is enabled to run continuously for a period of 60 minutes to dry the bristles of the brush. After the completion of 60 minutes or an alternative programmed time period, fan 44 is disabled.

Figure 10:
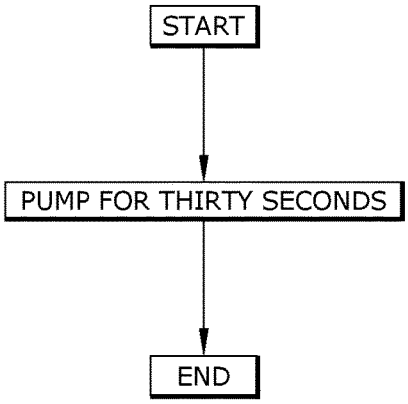
FIG. 10 depicts a flowchart of a method in accordance with certain embodiments of the invention.

After use of the automated cleaning and drying apparatus, clean button 38 is pushed to activate one or more pumps 88 for a period of 30 seconds as depicted in FIG. 10. Pumps 88 discharge any remaining cleaning solution present within tubing 108 and the piping leading to nozzle spray tips 96. The discharged cleaning solution is dispersed out of nozzle spray tips 96.

In an alternative embodiment, the automated cleaning and drying apparatus can be configured to communicate via Wi-Fi, Bluetooth or landline over a network with another computing device executing an application or software. The computing device can be used to operate the cleaning and drying apparatus from a remote location.

It shall be appreciated that various modifications can be made to the automated cleaning and drying apparatus. For example, the apparatus can be assembled and operated without fans 44 in an alternative embodiment. In one embodiment, any alternative number of pumps 88 and fans 44 can be assembled in the apparatus. In one embodiment, a single pump 88 and a single fan 44 are configured for use with the plurality of brushes 100, 102, 104. In one embodiment, pressure sensors and/or adjustable plates can be coupled to claw 90 and be used in conjunction with magnet 68 or alone to accommodate alternative types of brushes having different shapes and sizes. In one embodiment, one or more attachments made from any material having variable shapes and sizes can be used to attach alternative types of brushes to claw 90 of the apparatus. Each attachment may comprise a metal end tip configured to engage with magnet 68 within claw 90.

It shall be appreciated that the components of the automated cleaning and drying apparatus described in several embodiments herein may comprise any alternative known materials in the field and be of any color, size and/or dimensions. Components of the apparatus can be made from any plastic, metal, rubber or other materials known in the field. It shall be appreciated that the components of the automated cleaning and drying apparatus described herein may be manufactured and assembled using any known techniques in the field. It shall be appreciated that the components of the apparatus can be connected together using any fasteners including, but not limited to, snap-components, screws, bolts, nuts, brackets, adhesives and the like.

Persons of ordinary skill in the art may appreciate that numerous design configurations may be possible to enjoy the functional benefits of the inventive systems. Thus, given the wide variety of configurations and arrangements of embodiments of the present invention, the scope of the invention is reflected by the breadth of the claims below rather than narrowed by the embodiments described above.

What is claimed is:

1. An automated cleaning and drying apparatus configured for use to clean a brush, the brush comprising a bristle portion coupled to a handle with an end tip on an end of the brush opposite the bristle portion, the cleaning and drying apparatus comprising:

a main housing;

a bottle coupled to the main housing and comprising cleaning solution stored therein, the bottle connected to a spray nozzle configured to disperse the cleaning solution;

a fan coupled to the main housing;

a support frame assembly partially disposed within the main housing;

a rotation mechanism assembly coupled to the support frame assembly and comprising a rotatable claw configured to engage the end tip of the brush such that the brush can be held by the claw and rotated while being held by the claw; and a height adjustment mechanism assembly operably coupled to the support frame assembly within the main housing, wherein the height adjustment mechanism assembly is configured to adjust a height of the support frame assembly relative to the main housing, and wherein the height adjustment mechanism is powered by a motor;

a tray coupled to the main housing and configured to collect dispersed cleaning solution from the bottle;

a catch plate disposed on the tray, wherein the catch plate comprises a plurality of openings, and wherein the catch plate disposed on the tray is configured to contact the bristle portion of the brush while the brush is held by the claw and rotated;

wherein the height adjustment mechanism assembly is configured to adjust the height of the support frame assembly to a first position wherein the rotation mechanism assembly drives the rotatable claw to rotate the brush as the spray nozzle disperses the cleaning solution from the bottle to the bristle portion of the brush while the support frame assembly is in the first position, and wherein the height adjustment mechanism assembly is configured to adjust the height of the support frame assembly to a second position wherein the bristle portion of the brush is aligned with the fan such that the fan can blow air onto the bristle portion while the support frame assembly is in the second position.

2. The cleaning and drying apparatus of claim 1, wherein the height adjustment mechanism assembly comprises a slider housing coupled to the interior of the main housing and comprising a slot, a first gear motor coupled to the slider housing, a screw operably connected to the first gear motor and rotatably mounted to the support frame assembly, wherein the first gear motor is configured to rotate the screw in a first direction to raise the support frame assembly within the slot of the slider housing or a second direction to lower the support frame assembly within the slot of the slider housing.

3. The cleaning and drying apparatus of claim 2, wherein the rotation mechanism assembly comprises a second gear motor coupled to the support frame assembly, a nut plate operably connected to the second gear motor, a drive gear rotatably mounted to the support frame assembly and operably connected to the nut plate by a linkage arm, and a pinion gear of the rotatable claw engaged with the drive gear, wherein rotational movement of the second gear motor transfers through the nut plate, linkage arm, drive gear and rotatable claw to rotate the brush.

4. The cleaning and drying apparatus of claim 3, wherein the second gear motor is configured to rotate the rotatable claw in an alternating clockwise and counter-clockwise movement pattern.

5. The cleaning and drying apparatus of claim 4, further comprising a pump disposed within the main housing and coupled to the bottle by tubing, the spray nozzle being coupled to the pump, wherein the pump is configured to facilitate movement of the cleaning solution from the bottle through the tubing and out the spray nozzle.

6. The cleaning and drying apparatus of claim 5, further comprising a vent disposed in the main housing, a pad coupled to the interior of the main housing along a perimeter of the vent, the pad configured to permit attachment of the fan thereto.

7. A method for cleaning and drying a brush, the brush comprising a bristle portion coupled to a handle with an end tip, the method comprising:

providing the cleaning and drying apparatus recited in claim 1 maneuvering the end tip of the brush to engage with the rotatable claw of the rotation mechanism assembly;

activating the height adjustment mechanism assembly to adjust the height of the support frame assembly so the bristle portion of the brush is proximate the spray nozzle;

activating the rotation mechanism assembly to drive the rotatable claw to rotate the brush; and enabling the spray nozzle to disperse the cleaning solution from the bottle to the bristle portion of the brush.

8. The method of claim 7, further comprising activating the height adjustment mechanism assembly to adjust the height of the support frame assembly so the bristle portion of the brush is aligned with the fan, and activating the fan to dry the bristle portion of the brush.

* * * * *